US006321842B1

(12) United States Patent
Pringle et al.

(10) Patent No.: US 6,321,842 B1
(45) Date of Patent: Nov. 27, 2001

(54) FLOW CONTROL IN A WELLBORE

(75) Inventors: Ronald E. Pringle, Houston; Clay W. Milligan, Jr., Missouri City, both of TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/477,563

(22) Filed: Jan. 4, 2000

Related U.S. Application Data

(63) Continuation-in-part of application No. 09/325,474, filed on Jun. 3, 1999, now Pat. No. 6,227,302.

(51) Int. Cl.[7] ..... E21B 43/00

(52) U.S. Cl. ..... 166/313; 166/386; 166/375; 166/194; 166/320; 166/332.4; 166/332.5

(58) Field of Search ..... 166/386, 381, 166/313, 373–375, 387, 50, 186, 191, 194, 319, 320, 332.4, 332.5

(56) References Cited

U.S. PATENT DOCUMENTS

| | | | |
|---|---|---|---|
| 3,874,445 | | 4/1975 | Terral . |
| 3,889,748 | | 6/1975 | Tausch . |
| 4,135,576 | | 1/1979 | Tausch . |
| 4,295,796 | | 10/1981 | Moore . |
| 4,467,866 | | 8/1984 | Vazquez et al. . |
| 4,480,687 | | 11/1984 | Terral . |
| 5,547,029 | * | 8/1996 | Rubbo et al. . |
| 5,706,892 | * | 1/1998 | Aeschbacher et al. . |
| 5,706,896 | * | 1/1998 | Tubel et al. . |
| 5,732,776 | * | 3/1998 | Tubel et al. . |

* cited by examiner

*Primary Examiner*—Roger Schoeppel
(74) *Attorney, Agent, or Firm*—Trop Pruner & Hu PC

(57) ABSTRACT

A completion string for use in a wellbore includes a tubing having a bore and a housing providing a main bore communicating with the tubing bore and further defining plural side bores generally parallel to each other. A plurality of valves are positioned proximal respective side bores to control fluid flow. An actuator is coupled to the valves to actuate the valves to at least open and closed positions. The valves may be part of tubular flow elements mounted to the housing, each tubular flow element including a bore that forms part of a respective side bore. Each valve may include a sleeve valve or a disk valve. The housing may include a side pocket mandrel.

37 Claims, 9 Drawing Sheets

FLOW CONTROL IN A WELLBORE

This is a continuation-in-part of U.S. Ser. No. 09/325,474, entitled "Apparatus and Method for Controlling Fluid Flow in a Wellbore," filed Jun. 3, 1999 now U.S. Pat. No. 6,227,302.

BACKGROUND

The invention relates to flow control in a wellbore.

In completing a well, one or more zones in one or more formations may be perforated to enable production of hydrocarbons. Completion equipment including tubing, packers, flow control devices, and other devices may be installed in various positions in the well to manage the production from respective zones. Flow control devices may include valves such as sleeve valves, disk valves, ball valves, flapper valves, and other types of valves. A sleeve valve typically includes a sliding sleeve that extends around the full circumference of a tubing or pipe having one or more flow orifices. The sliding sleeve is movable with respect to the flow orifices to provide flow control. Elastomeric seals are used to provide the desired sealing when the sliding sleeve is in the closed position. Another type of valve is the disk valve, which includes a cover that is slidable with respect to a seat defining an orifice. The peripheries of the cover and seat provide the desired sealing. The cover and seat may be formed of or coated with a material having a low coefficient of friction to facilitate sliding movement between the cover and seat to open and close the disk valve.

One of the concerns associated with flow control devices is the flow area that such flow control devices provide. For example, the orifice or orifices that a sleeve valve or disk valve controls may have a flow area that is smaller than the flow area of a tubing or pipe used to carry the fluid to the surface. As a result, "full bore flow" may not be achieved by the valve, which may have the effect of limiting fluid flow rate during production.

Thus, a method and apparatus is needed to increase flow areas provided by flow control devices.

SUMMARY

In general, according to one embodiment, an apparatus for controlling fluid flow in a wellbore includes a housing defining a main bore and a plurality of side bores. Valves are positioned proximal corresponding side bores to control fluid flow into or out of the side bores.

Other features and embodiments will become apparent from the following description, the drawings, and the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
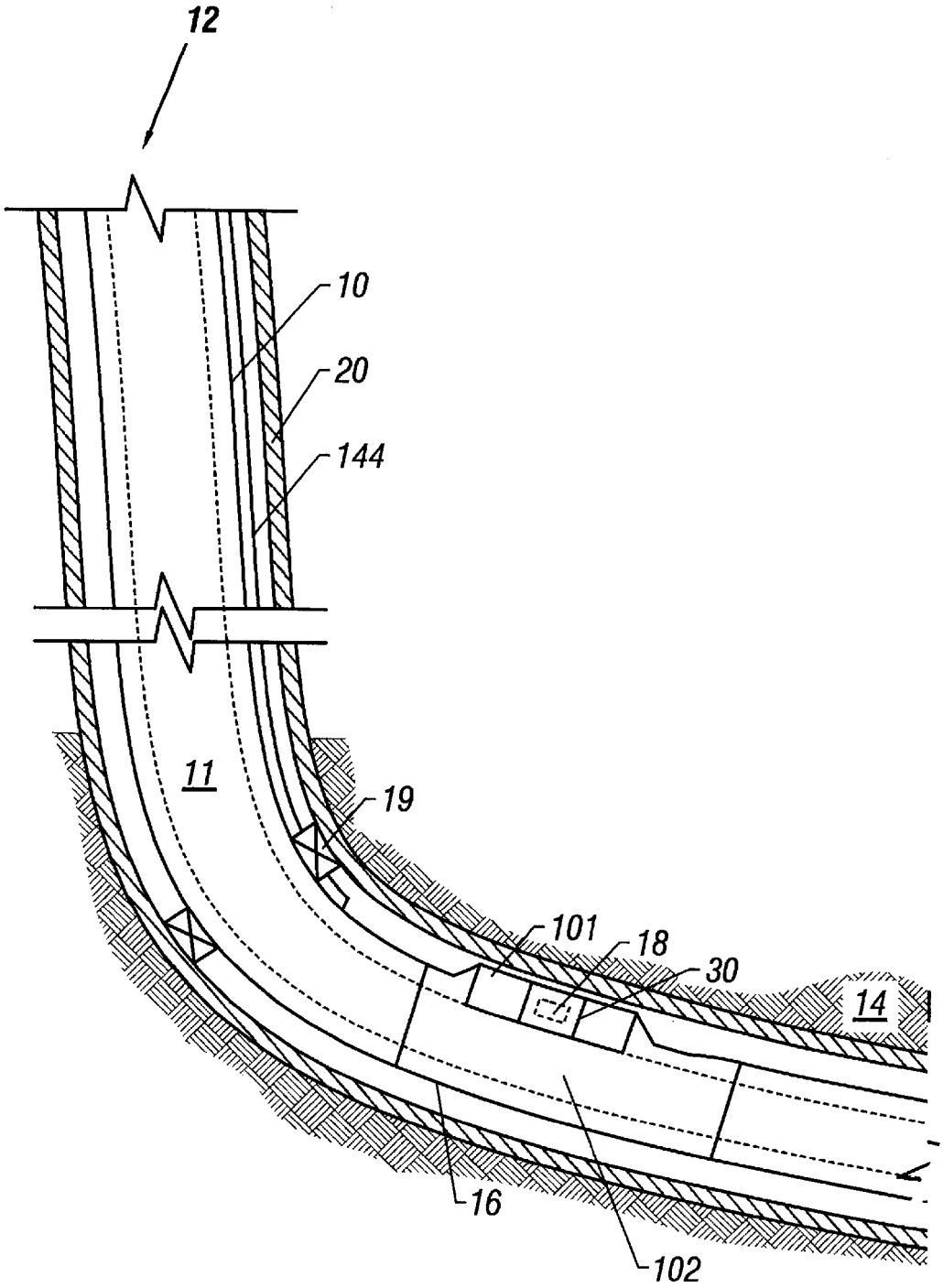
FIG. 1 illustrates an embodiment of a completion string positioned in a wellbore.

Referring to FIG. 1, a completion string in accordance with one embodiment is positioned in a wellbore 12. The completion string includes a tubing 10 (e.g., a production tubing or other type of tubing or pipe), a packer 19, and at least one flow control module 16 having fluid flow orifices or ports 18 in the proximity of a formation zone 14. The wellbore 12 may be lined with casing 20. The term "tubing" as used here has a general meaning and includes pipes, annular regions, mandrels, conduits, or any structure including a passageway through which fluid can flow.

In accordance with some embodiments, the flow control module 16 may include a housing, which may be a side pocket mandrel having plural side pockets, defining a main bore 102 that is in communication with the bore 11 of the tubing 10. The housing of the flow control module 16 also defines a plurality of side bores arranged generally in parallel. Valves 30 may be positioned proximal the side bores to control fluid flow into or out of the orifices or ports 18. The valves 30 may be part of tubular flow elements 101 that are mounted in the housing of the flow control module 16. During production, hydrocarbons from the surrounding formation 14 may flow through the orifices or ports 18 (as controlled by the valves 30), into the plurality of side bores, and finally into the main bore 102 of the flow control module housing for flow up the tubing 10. The plural side bores in the flow control module 16 are designed to increase the available flow area through the flow control module 16. The flow control module 16 is capable of providing a larger flow area when the generally parallel valves 30 are all actuated open. In a further embodiment, multiple flow control modules 16 may be employed to further increase flow area.

The valves in the flow control module 16 may be set to an open position, a closed position, and optionally, to one or more intermediate positions. As used here, a closed position does not necessarily mean complete blockage of fluid flow. Rather, some acceptable fluid leakage may occur through the valve. For example, such leakage may be about six percent or less of the fluid flow when the flow control device is fully open.

According to some embodiments, relatively efficient and cost-effective flow control modules that are capable of achieving full bore flow are provided. In one design, the flow control module provides for on/off actuation (without intermediate positions) to reduce complexity of design. However, if desired, the flow control module may provide for one or more intermediate positions between the fully open and closed positions in further embodiments. In addition, by arranging the side bores and valves 30 generally in parallel, the length of the flow control module can be reduced while still providing for a relatively large composite flow area. Thus, in portions of the wellbore where space may be limited, the flow control module may be advantageously used.

The plurality of valves 30 in respective side bores may be actuated by an actuator, which may be a hydraulic actuator, mechanical actuator, electric actuator (e.g., a motor), or a gas pressure actuator. Hydraulic power, electrical power and signaling, and gas pressure may be provided down one or more control lines 144 that extend from the well surface to the flow control module 16.

In one embodiment, the valves 30 in the side bores of the flow control module 16 may be sliding sleeve valves arranged generally in parallel in the side bores. In another embodiment, the valves 30 may be disk valves, such as those described in U.S. patent application Ser. No. 09/243,401, entitled "Valves for Use in Wells," filed Feb. 1, 1999, having common assignee as the present application and hereby incorporated by reference.

Figure 2A:
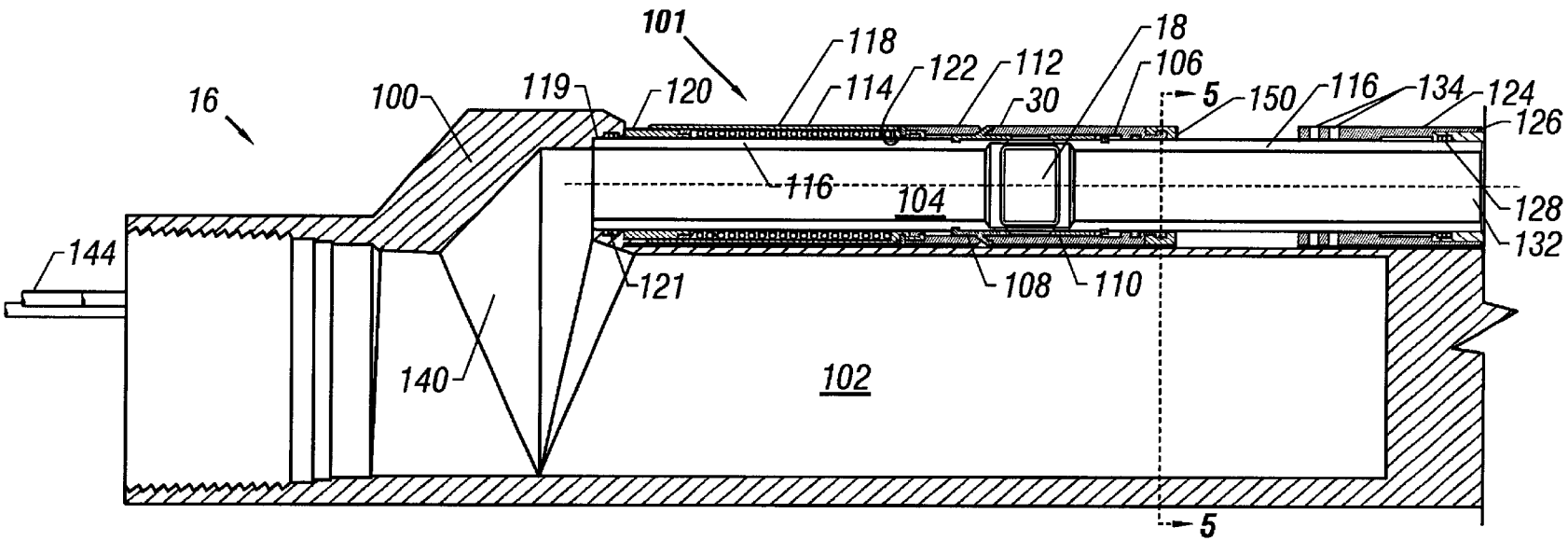
FIGS. 2A–2B are a longitudinal sectional view of a flow control module in accordance with one embodiment in the completion string of FIG. 1, the flow control module including a housing defining a main bore and a plurality of side bores and further including tubular flow elements positioned in alignment with the side bores.
Figure 2B:
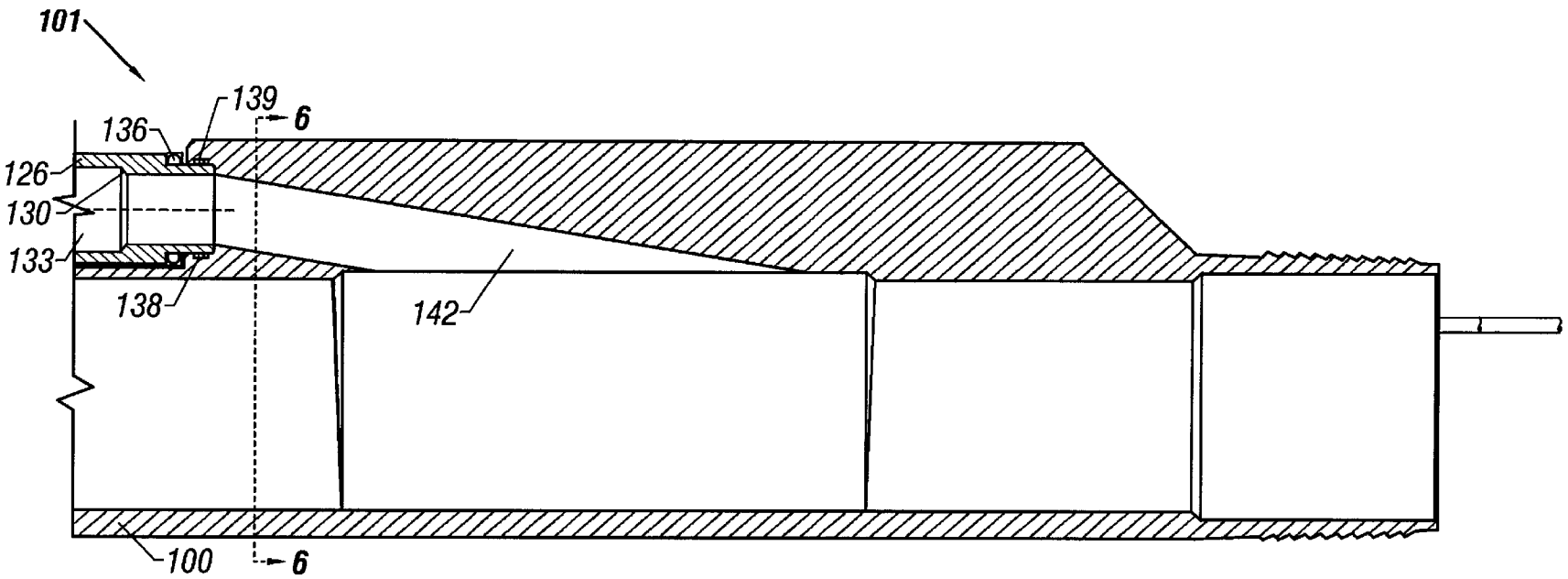

Referring to FIGS. 2A–2B, a longitudinal sectional view of the flow control module 16 is shown. The flow control module 16 includes a housing 100 having an upper end and a lower end with threaded connections for attachment to respective tubing 10 sections. The housing 100 of the flow control module 16 defines the main bore 102 that is generally coaxial with the bore 11 of the tubing 10. The housing 100 also defines a plurality of side bores 104. The valve 30 is positioned proximal each side bore 104 to control fluid flow through a respective orifice 18. Although only one orifice 18 is shown in each side bore 104, further embodiments may include a plurality of orifices. Each valve 30 may be part of a tubular flow element 101 that can be mounted to the housing 100.

In one embodiment, the side of the housing 100 may define an opening through which the tubular flow elements 101 may be inserted for mounting to the housing 100. Each tubular element 101 includes a bore that forms part of the side bore 104. The tubular flow element 101 may initially be in a retracted position. Once the retracted tubular flow element 101 is positioned in the housing such that the bore of the tubular element 101 is aligned with a respective side bore of the housing 100, the tubular element 101 may be extended to mount to the housing 100. This provides a convenient mounting mechanism, and is further discussed below in connection with FIGS. 7 and 8.

The tubular flow element 101 includes an inner tube 116 that defines the orifice 18. The valve 30 in one embodiment includes a sliding sleeve 106 that covers the orifice 18 in the position shown in FIG. 2A. Seals 108 and 110 are provided inside the sliding sleeve 106 to seal off the orifice 18 when the valve 30 is in its closed position, as illustrated. The seals 108 and 110 may be dynamic sealing gaskets formed of a flexible material such as elastomer or other suitable material.

In one embodiment, the sliding sleeve 106 is mounted outside the inner tube 116. As the sliding sleeve 106 is moved with respect to the orifice 18, a portion of the seal 108 may be uncovered by the sliding sleeve 106, which may leave it exposed to wellbore fluids (since the sliding sleeve 106 is mounted outside the inner tube 116). To protect the seal 108, a protective sleeve 112 may be positioned next to the sliding sleeve 106. The protective sleeve 112 is in abutment with the sliding sleeve 106 to provide a continuous cover for the seal 108. Thus, if the sliding sleeve 106 moves downwardly when the valve 30 is actuated open, the protective sleeve 112 moves downwardly along with the sliding sleeve 106 to maintain the cover for the seal 108. The protective sleeve 112 protects the seal 108 from exposure to high-rate fluid flow, which may rapidly wear the seal 108.

The upper end of the protective sleeve 112 is connected to a spring sleeve 114. The spring sleeve 114 and the inner tube 116 define an annular space in which a spring 118 may be positioned. In another embodiment, a gas charge chamber may be provided in place of the spring 118. The upper end of the spring 118 contacts a shoulder provided by an upper flange 120 that is fixedly positioned with respect to the housing 100 of the flow control module 16. The lower end of the spring 118 pushes against a shoulder 122 defined by the spring sleeve 114. The spring 118 provides a downwardly acting force against the shoulder 122 of the spring sleeve 114 that applies a downward force on the protective sleeve 112 to abut the protective sleeve 112 against the sliding sleeve 106. The lower end of the sliding sleeve 106 is connected to an actuator connector member 150 (cross-section shown in FIG. 5) that is connected to an actuator rod (shown in FIGS. 3A–3B).

The upper end of the inner tube 116 is mounted in a receptacle 119 of the housing 100, with a seal 121 provided between the housing 100 and inner tube 116. The lower end of the inner tube 116 is received in an adapter 126 of the tubular element 101. The adapter 126 is in turn mounted to a lower receptacle 139 in the housing 100 (FIG. 2B). A locking sleeve 124 is mounted around the outer surface of the inner tube 116 above the adapter 126. Locking pins 134 in the locking sleeve 124 are engageable in grooves in the outer surface of the inner tube 116 to lock the locking sleeve 124 with respect to the inner tube 116. The lower end of the locking sleeve 124 abuts an upper end of the adapter 126. A spring 136 maintains the adapter 126 in position with respect to the flow control module housing 100. The seals 128 and 138 provide isolation for fluid flow at the lower end of the side bore 104. The side bore 104 communicates with the main bore 102 through outlets 140 and 142.

Figure 3A:
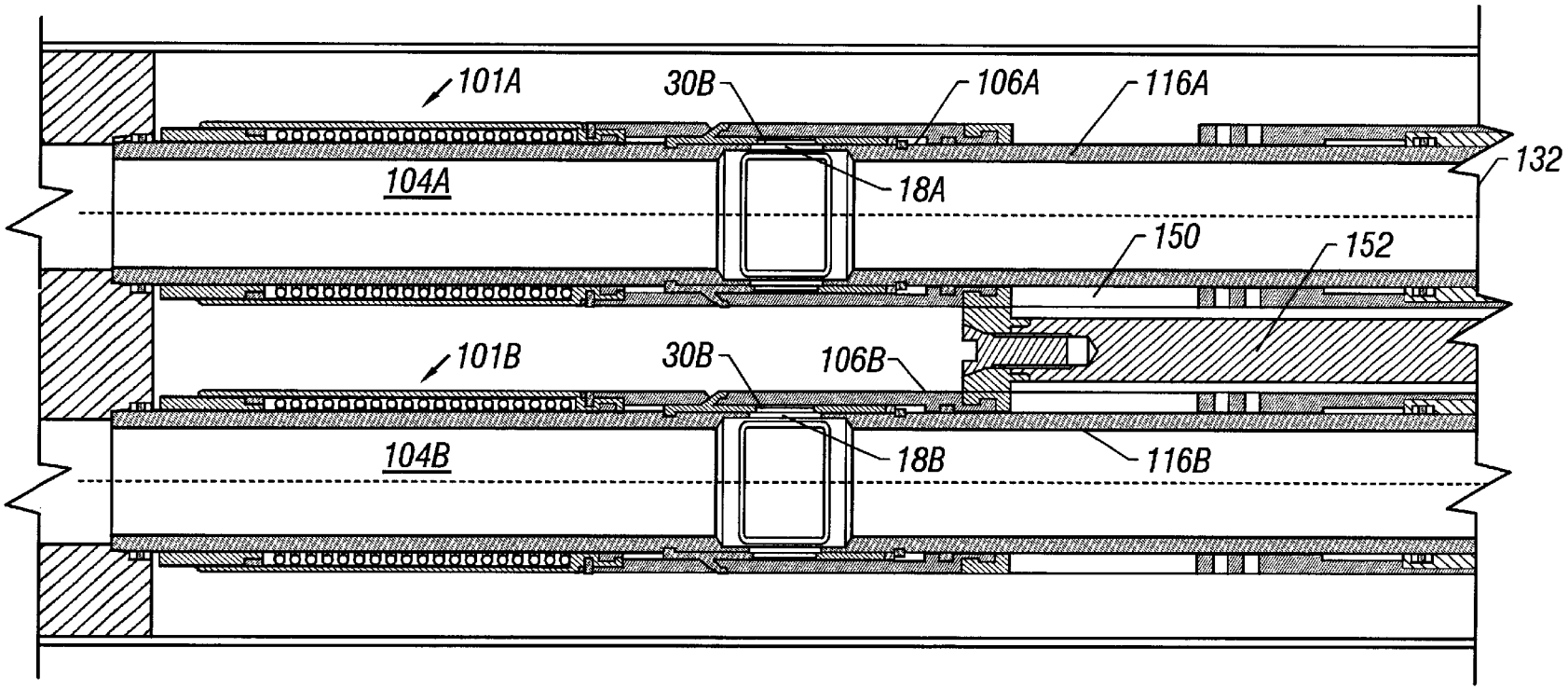
FIGS. 3A–3B are a longitudinal sectional view of the flow control module of FIGS. 2A–2B taken along section 3—3.
Figure 3B:
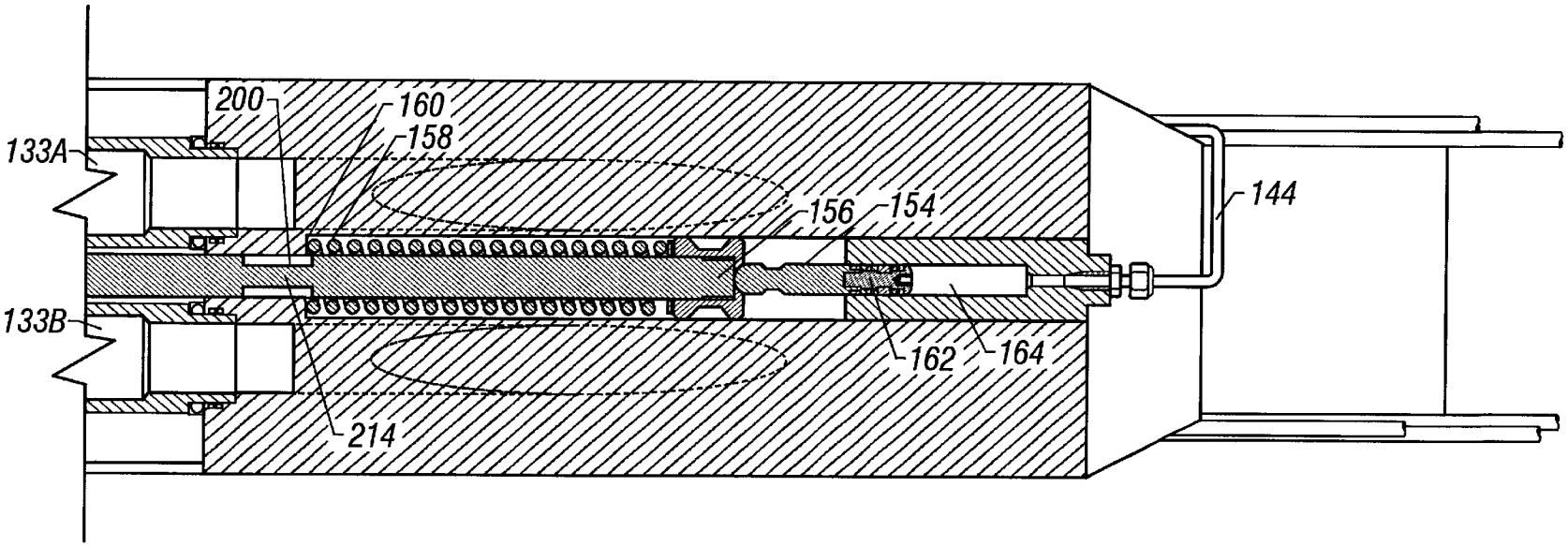

In accordance with one embodiment, the valves 30 positioned proximal the side bores 104 of the flow control module 16 are actuatable by a hydraulic mechanism, as shown in FIGS. 3A–3B. Hydraulic pressure to activate the hydraulic mechanism may be communicated down control lines 144. In an alternative arrangement, the actuator may include electrical actuators or gas-activated actuators. In such further arrangements, the control lines 144 may be adapted to carry electrical conductors or gas pressure.

Figure 5:
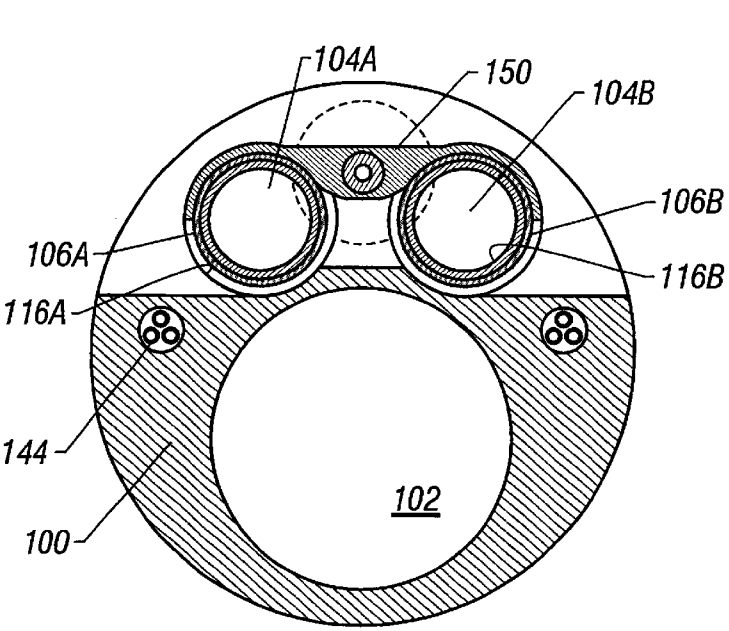
FIG. 5 is a cross-sectional view of the flow control module of FIGS. 2A–2B taken along section 5—5 illustrating a key for engaging the slots of FIG. 4.

Referring to FIGS. 3A–3B and 5, two side bores 104A and 104B are illustrated. Additional side bores may further be provided in the flow control module 16. The side bores 104A and 104B include bores of respective tubular flow elements 101A and 101B and respective side bores of the housing 100. The tubular flow elements are mounted to corresponding portions of the flow control module housing 100. Valves 30A and 30B are mounted outside respective tubular flow elements 101A and 101B to control fluid flow through respective orifices 18A and 18B. The orifices 18A and 18B are defined in respective inner tubes 116A and 116B.

The lower ends of the sliding sleeves 106A and 106B in respective valves 30A and 30B are both connected to the actuator connector member 150, which is attached to an actuating rod 152. The same actuating mechanism can thus be used to concurrently actuate the generally parallel valves 30A and 30B. In an alternative arrangement, separate mechanisms may be used. The actuating rod 152 extends along the length of the flow control module 16 to a connector 154. A cap 156 is attached about the lower end of the actuating rod 152. A spring 158 is positioned in an annular space defined between the actuating rod 152 and the inner wall of the flow control module housing 100 to bias the actuating rod 152 downwardly. The lower end of the spring 158 abuts one end of the cap 156, while the upper end of the spring 158 sits against a shoulder 160 provided by the housing 100.

The lower end of the connector 154 is connected to a piston 162 having one end in communication with a chamber 164. The chamber 164 is connected to a control line 144 that contains hydraulic pressure. Hydraulic pressure present in the line 144 is communicated to the chamber 164, which applies an upward force to move the piston 162 upwardly. In another embodiment, the control line 144 may carry a gas pressure instead of hydraulic pressure. In yet another embodiment, the actuator may be an electrical actuator, such as a motor or a solenoid actuator.

In operation, hydraulic pressure applied down the control line 144 pushes the piston 162 upwardly. This in turn moves the actuating rod 152 and attached cap 156 upwardly to compress the spring 158. If the valves 30A, 30B are initially in the open position, application of the hydraulic pressure in the control line 144 pushes the sliding sleeves 106A, 106B upwardly to close the valves 30A, 30B. In an alternative arrangement, the valves 30A and 30B may initially be in the closed position, with upward movement of the actuating rod 152 opening the valves 30A, 30B. In one embodiment, once pressure is released in the hydraulic line 144, the spring 158 pushes the cap 156 and actuating rod 152 downwardly to move the sliding sleeves 106A, 106B down (back to the open position).

Figure 4:
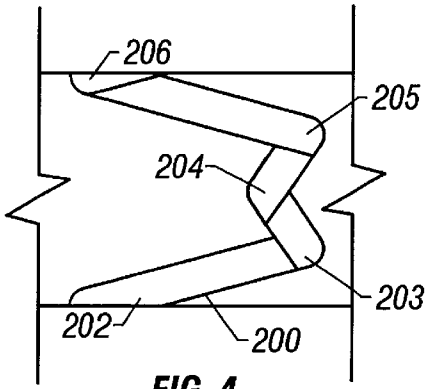
FIG. 4 illustrates an arrangement of slots for cooperating with an actuator to control the position of the flow control module of FIGS. 2A–2B.

In an alternative arrangement, a slot arrangement, such as an arrangement of slots 200 in FIG. 4, may be used to maintain the valves 30A, 30B in the closed position even after pressure is released in the hydraulic line 144. As shown in FIG. 3B, the slot arrangement 200 may be provided in the outer surface of the actuating rod 152. The slot arrangement 200 may be formed on the surface of a narrowed section 214 of the rod 152. A key 210 (FIG. 6) connected to the flow control module housing 100 may traverse the slot 200 to control movement of the actuating rod 152.

Figure 6:
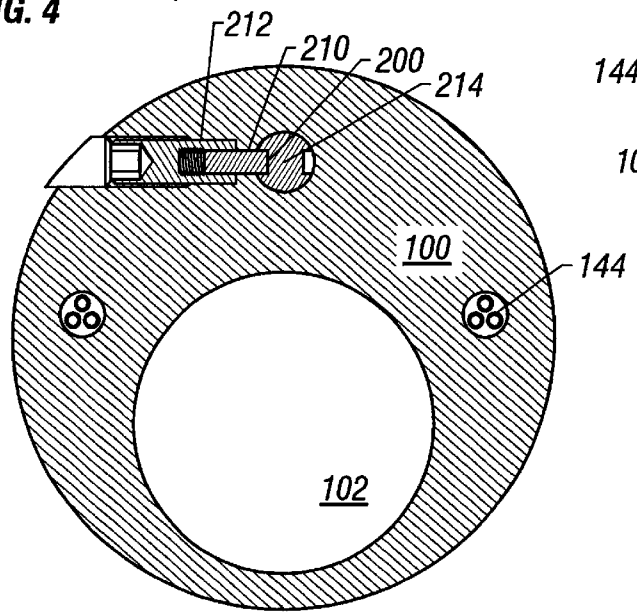
FIG. 6 is a cross-sectional view of the flow control module of FIGS. 2A–2B taken along section 6—6 illustrating sliding sleeves in the flow control module.

Referring to FIGS. 4 and 6, the key 21 (which is pushed against the rod section 214 by a spring 212) may start in position 202 in the slot arrangement 200. In the FIGS. 3A–3B embodiment, this corresponds to the open position of the valves 30A, 30B. Application of hydraulic pressure 144 moves the actuating rod 152 upwardly to thereby move the key 210 to position 203 in the slot arrangement. When pressure is released in the hydraulic line 144, the key 210 traverses the slot arrangement 200 to position 204. The position 204 limits movement of the actuating rod 152 so that the valves 30A, 30B are maintained in the closed position, as shown in FIG. 3A. To open the valves 30A, 30B, hydraulic pressure can again be applied in control line 144 to move the pin along the slot arrangement 200 to position 205. Release of hydraulic pressure in the control line 144 allows the pin to traverse the slot arrangement 200 to position 206. This allows the actuating rod 152 to move downwardly to again open the valves 30A, 30B.

Thus, effectively, a first pressure cycle (application and removal of predetermined pressure) actuates the valves 30A, 30B from an open position to a closed position, while the next pressure cycle actuates the valves 30A, 30B from the closed position to the open position. In further embodiments, the slot arrangement 200 may be modified to allow control by multiple pressure cycles. For example, two or more pressure cycles may be needed to open or close the valves 30A, 30B. In yet another embodiment, a modification of the slot arrangement 200 may be used to provide incremental control of the valves 30A, 30B. In such an embodiment, the valves 30A, 30B may be incrementally actuated to one or more intermediate positions between the open and closed positions. This provides finer control of fluid flow into or out of the side bores 104A, 104B during production or injection of fluids.

Figure 7:
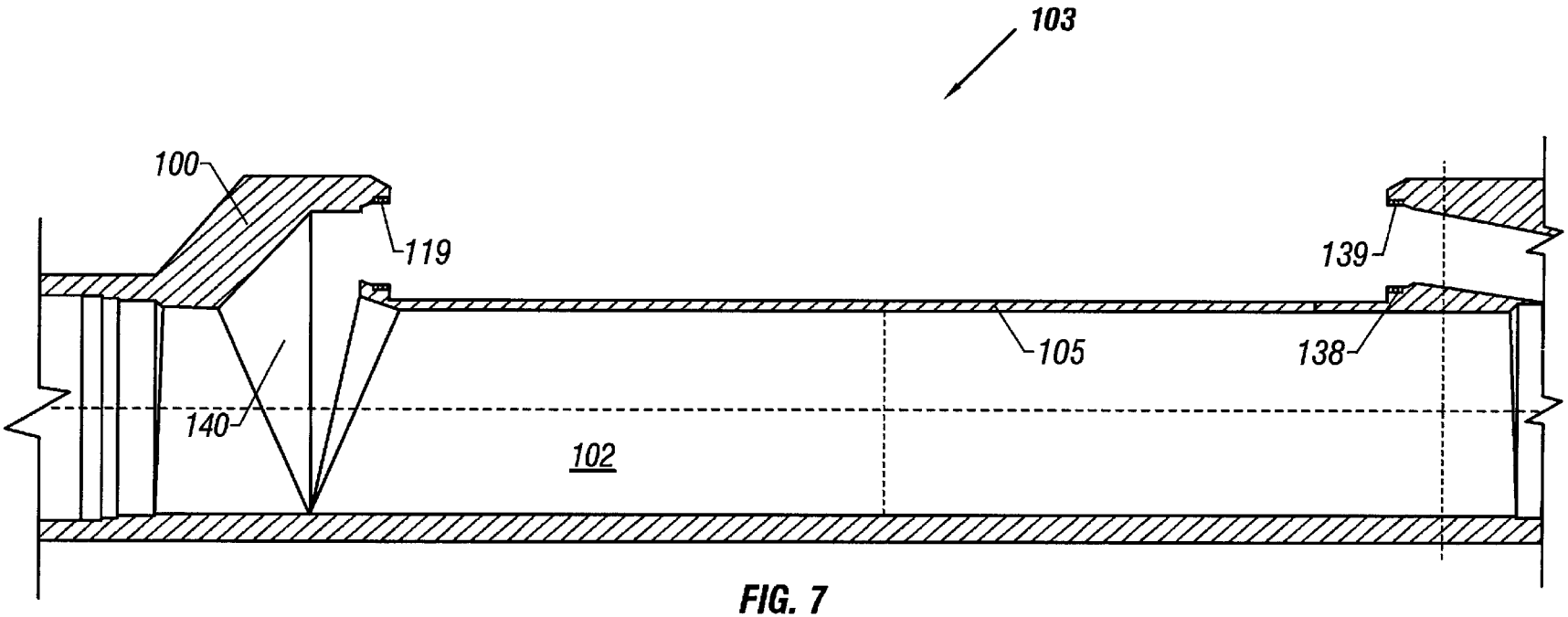
FIG. 7 is a longitudinal sectional view of the housing of the flow control module without tubular flow elements mounted.
Figure 8:
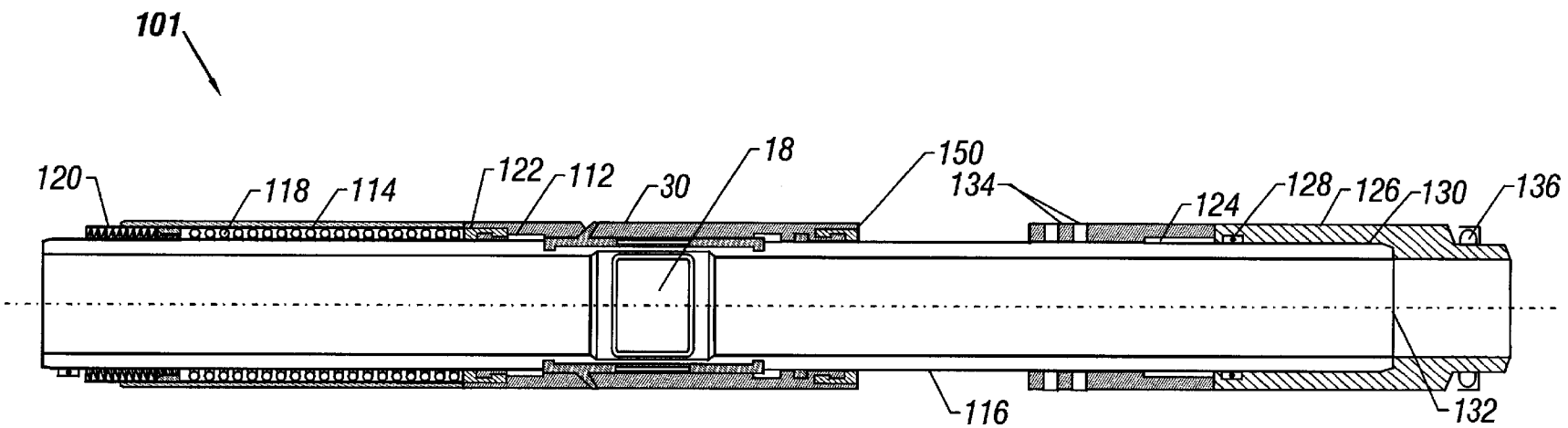
FIG. 8 is a longitudinal sectional view of a tubular flow element.

Referring to FIGS. 7 and 8, a feature of the tubular elements 101 is that they may be conveniently installed in the flow control module housing 100. FIG. 7 shows the flow control module 16 without the tubular elements 101 mounted. An opening 103 is provided in the flow control module having 100 through which retracted tubular elements 101 may be inserted for mounting. An inner wall 105 of the housing 100 separates the side bores of the flow control module from the main bore 102. In an alternative arrangement, a radial orifice may be provided in the inner wall to communicate fluid between the side bores and main bore 102.

FIG. 8 shows a tubular element 101 in the retracted position. In the retracted position, the locking sleeve 124 and adapter 126 are in an upper position so that the lower end 132 of the inner tube 132 engages the shoulder 130 of the adapter 126. Once a retracted tubular element 101 is inserted through the opening 103 of the flow control module housing 100, the connector sleeve 124 and adapter 126 may be pulled downwardly to extend the tubular element 101 for mounting in the flow control module housing 100. Once extended, the upper end of the tubular element 101 fits into the upper receptacle 119 while the lower end of the tubular element 101 fits into the lower receptacle 139. Once the tubular element 101 is engaged in the flow control module housing 100, as shown in FIGS. 2A–2B, flow control between the outside and inside of the housing 100 can be provided by the valve 30.

Figure 9:
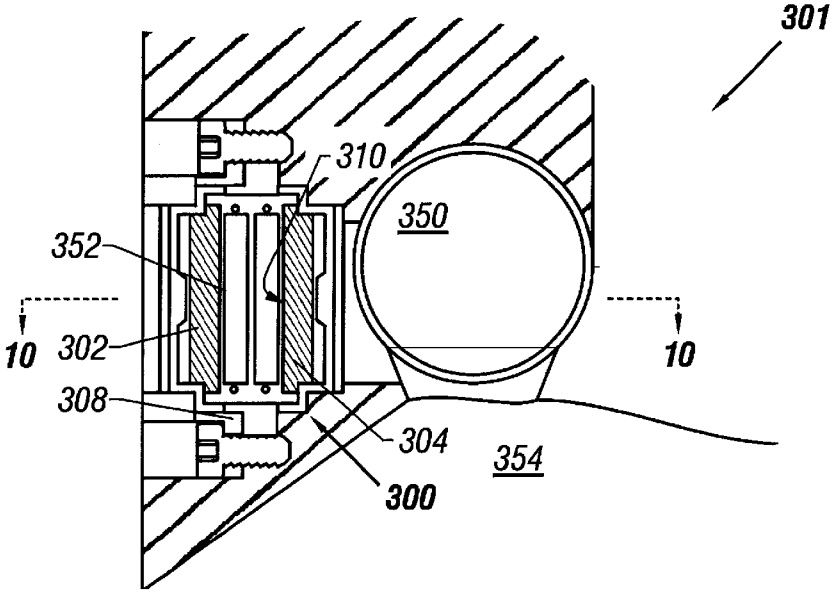
FIG. 9 is a cross-sectional view of a portion of the flow control module that includes disk valves instead of sleeve valves in accordance with an alternative embodiment.
Figure 10:
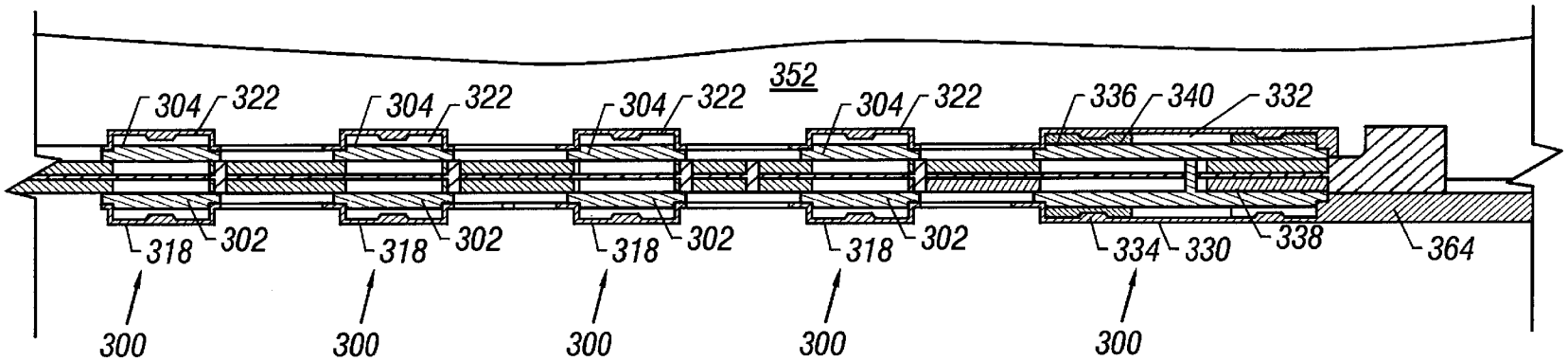
FIG. 10 is a longitudinal sectional view of the flow control module of FIG. 9.

In another embodiment, other types of valves may be used, such as disk valves. Further, instead of a single orifice 18 in each side bore 104 as shown in FIGS. 2A–2B, plural orifices may be provided in each side bore. Referring to FIGS. 9 and 10, a portion of an alternative embodiment of a flow control module 301 including disk valves 300 is illustrated. As shown in FIG. 9, each disk valve 300 controls fluid flow through an orifice 352 into or out of a side bore 350 of the flow control module 301. One or more additional side bores 350 may also be present. The flow control module 301 further includes a main bore 354 in communication with the side bores 350. The disk valve 300 has an outer cover 302 and an inner cover 304 on outer and inner sides of the orifice 352. The outer and inner covers 302 and 304 of each disk valve 300 may be in the form of disks that are in slidable engagement with seats 308 and 310, respectively. Covers 302 and 304 are slidable over the seats 308 and 310 to provide a variable orifice. Each disk valve 300 can selectively choke the orifice 352.

By having a cover on each side of the orifice 352, pressure integrity in the disk valve 300 may be maintained in the presence of pressure from either direction (from outside or inside the flow control module 301). In further embodiments, a cover may be used only on one side of the orifice 352 with some mechanisms (such as a pre-load spring) included to apply a pre-load force against the cover so that cover can maintain a seal even in the presence of pressure that tends to push the cover away from the seat of the disk valve 300.

To facilitate sliding movement of the covers 302 and 304 over surfaces of the seats 308 and 310 in each disk valve 300, contact surfaces of the covers and seats may be formed of or coated with a material having a relatively low coefficient of friction. Such a material may include polycrystalline-coated diamond (PCD). Other materials that may be used include vapor deposition diamonds, ceramic, silicone nitride, hardened steel, carbides, cobalt-based alloys, or other low-friction materials having suitable erosion resistance.

As shown in FIG. 10, the disk valves 300 are actuated by movement of an actuating member 364 that is connected to actuator cover carriers 330 and 332 for moving the valves 300 back and forth in an axial direction. The actuator cover carriers 330 and 332 are attached to actuator covers 334 and 336, respectively. The actuator covers 334 and 336 are fixedly attached to each other by a coupling member 338 that is passed through an interconnecting port 340.

The actuator cover carriers 330 and 332 are connected to sequentially arranged disk carriers 318 and 322, respectively, each attached to respective covers 302 and 304. Thus, longitudinal movement of the actuator member 364 by an actuator causes carriers 318 and 322 of the individual disk valves 300 to be moved together between open and closed positions.

In other embodiments, other arrangements of valves may be used. While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. An apparatus for controlling fluid flow in a wellbore, comprising:

a housing defining a main bore and a plurality of side bores;

valves positioned proximal the plurality of side bores to control fluid flow into or out of the side bores; and an actuator having a moveable element coupled to the valves to operate the valves.

2. The apparatus of claim 1, wherein the side bores extend generally in parallel.

3. The apparatus of claim 2, wherein the valves are positioned generally in parallel.

4. The apparatus of claim 1, wherein the actuator is adapted to operate the valves together.

5. The apparatus of claim 1, wherein the actuator includes a hydraulic actuator.

6. The apparatus of claim 1, wherein the actuator includes an electrical actuator.

7. The apparatus of claim 1, wherein the actuator includes a gas pressure actuator.

8. The apparatus of claim 1, wherein the valves include sleeve valves.

9. An apparatus for controlling fluid flow in a wellbore, comprising:

a housing defining a main bore and a plurality of side bores;

valves positioned proximal the plurality of side bores to control fluid flow into or out of the side bores;

an actuator coupled to operate the valves, wherein the valves include sleeve valves; and plural members positioned proximal respective side bores, each member defining at least one orifice, wherein each sleeve valve including a sliding sleeve is adapted to slide over a corresponding at least one orifice.

10. The apparatus of claim 9, wherein the plural members include tubes, each sliding sleeve mounted outside a corresponding tube.

11. The apparatus of claim 10, wherein each sleeve valve further includes at least one seal, the sliding sleeve moveable with respect to the at least one seal.

12. The apparatus of claim 11, wherein each sleeve valve further includes a protective sleeve adapted to be moved in conjunction with the sliding sleeve, the protective sleeve adapted to provide a cover for a portion of the at least one seal when the sliding sleeve does not cover the portion.

13. An apparatus for controlling fluid flow in a wellbore, comprising:

a housing defining a main bore and a plurality of side bores;

valves positioned proximal the plurality of side bores to control fluid flow into or out of the side bores; and an actuator coupled to operate the valves, wherein the valves include disk valves.

14. The apparatus of claim 13, further comprising plural members defining one or more fluid flow orifices in respective side bores, wherein the disk valves include covers adapted to open or shut the orifices.

15. The apparatus of claim 14, wherein the members are mounted to the housing.

16. The apparatus of claim 1, further comprising plural tubular flow elements mounted to the housing, each tubular flow element including a bore that is part of a respective side bore.

17. The apparatus of claim 16, wherein each valve is attached to a respective tubular flow element.

18. The apparatus of claim 16, wherein each tubular flow element has a retracted position and an extended position, each tubular flow element adjusted to the extended position from the retracted position to mount to the housing.

19. The apparatus of claim 18, wherein the housing includes one or more openings adapted to receive the tubular flow elements in their retracted position.

20. The apparatus of claim 1, wherein the moveable element is positioned between the side bores to connect to the valves.

21. A completion string for use in a wellbore, comprising:

a tubing having a bore;

a housing providing a main bore communicating with the tubing bore, the housing further defining plural side bores generally parallel to each other;

a plurality of valves proximal respective side bores to control fluid flow; and a plurality of tubular flow elements mounted to the housing, each tubular flow element including a bore that forms part of a respective side bore, wherein each valve includes a sleeve valve, and wherein each tubular flow element provides at least one orifice, and wherein each sleeve valve includes at least one sliding sleeve adapted to cover the at least one orifice.

22. The completion string of claim 21, further comprising an actuator coupled to the valves to actuate the valves to at least open and closed positions.

23. The completion string of claim 21, wherein the housing includes a side pocket mandrel.

24. A completion string for use in a wellbore, comprising:

a tubing having a bore;

a housing providing a main bore communicating with the tubing bore, the housing further defining plural side bores generally parallel to each other;

a plurality of valves proximal respective side bores to control fluid flow; and plural tubular flow elements including respective valves, the plural tubular flow elements mountable to the housing in respective side bores, wherein each tubular flow element has a retracted position and an extended position, the tubular flow element mounted to the housing when in the extended position.

25. A method of controlling fluid flow in a wellbore, comprising:

providing a flow control module having a main bore and plural side bores that are positioned generally parallel to each other;

providing valves positioned proximal the side bores;

providing an actuator having a moveable element coupled to the valves; and activating the actuator to move the moveable element to actuate the valves generally in parallel to enhance flow area when the valves are in the open position.

26. The method of claim 25, wherein activating the actuator includes activating a hydraulic actuator.

27. The method of claim 25, wherein activating the actuator includes activating an electrical actuator.

28. The method of claim 25, wherein activating the actuator includes activating a gas pressure actuator.

29. The method of claim 25, wherein providing the valves includes attaching the valves to respective tubular flow elements that are mounted to a housing of the flow control module.

30. The method of claim 29, wherein attaching each valve includes positioning the valve proximal an orifice defined by a corresponding tubular flow element.

31. The method of claim 30, wherein providing the valves comprises providing sleeve valves slideably engaged to the orifice of each tubular flow element.

32. The method of claim 25, wherein providing the valves includes providing one of sleeve valves and disk valves.

33. The method of claim 25, wherein providing the actuator comprises providing the moveable element between the side bores to connect to the valves.

34. A method of mounting flow control devices in a component for use in a wellbore, the component including one or more openings, a main bore, and a plurality of side bores, the method comprising:

providing the flow control devices in a retracted position;

positioning the retracted flow control devices through the one or more openings, each flow control device including a bore; and extending the flow control devices once the bores of the flow control devices are aligned with corresponding side bores in the component; and attaching the flow control devices to the component.

35. An apparatus for use in a wellbore, comprising:

a housing providing a main bore and at least one side bore, the housing defining an opening proximal the side bore; and a flow element having a retracted position to enable the flow element to fit through the opening, the flow element further having an extended position to enable the flow element to be mounted in the side bore.

36. The apparatus of claim 35, wherein the housing provides another side bore, the apparatus further comprising another flow element having a retracted position and an extended position for mounting in the other side bore.

37. The apparatus of claim 35, wherein the flow element comprises a valve.

* * * * *